US008975810B2

(12) United States Patent
Raizen et al.

(10) Patent No.: US 8,975,810 B2
(45) Date of Patent: Mar. 10, 2015

(54) COMPOSITIONS OF MERCURY ISOTOPES FOR LIGHTING

(71) Applicant: Board of Regents, The University of Texas System, Austin, TX (US)

(72) Inventors: Mark G. Raizen, Austin, TX (US); James E. Lawler, Madison, WI (US)

(73) Assignee: Board of Regents, The University of Texas System, Austin, TX (US)

( * ) Notice: Subject to any disclaimer, the term of this patent is extended or adjusted under 35 U.S.C. 154(b) by 0 days.

(21) Appl. No.: 14/276,758

(22) Filed: May 13, 2014

(65) Prior Publication Data

US 2014/0333197 A1 Nov. 13, 2014

Related U.S. Application Data

(60) Provisional application No. 61/822,897, filed on May 13, 2013.

(51) Int. Cl.

| | |
|---|---|
| ***H01J 1/62*** | (2006.01) |
| ***H01J 61/20*** | (2006.01) |
| ***C22C 7/00*** | (2006.01) |

(52) U.S. Cl.
CPC .. *H01J 61/20* (2013.01); *C22C 7/00* (2013.01)
USPC ..... 313/485; 313/639

(58) Field of Classification Search
USPC ..... 313/485, 639; 445/9
See application file for complete search history.

(56) References Cited

U.S. PATENT DOCUMENTS

| | | | | |
|---|---|---|---|---|
| 3,673,406 A | | 6/1972 | Nief et al. | |
| 4,379,252 A | * | 4/1983 | Work et al. | 313/485 |
| 4,527,086 A | | 7/1985 | Maya | |
| 4,596,681 A | | 6/1986 | Grossman et al. | |
| 4,629,543 A | * | 12/1986 | Grossman et al. | 205/562 |
| 4,648,951 A | | 3/1987 | Maya | |
| 4,661,078 A | * | 4/1987 | Grossman et al. | 445/9 |
| 4,793,907 A | | 12/1988 | Paisner et al. | |
| 4,808,136 A | | 2/1989 | Schuster | |
| 5,024,738 A | | 6/1991 | Grossman et al. | |

(Continued)

OTHER PUBLICATIONS

J. Maya, M. W. Grossman, R. Lagushenko, and J. F. Waymouth, "Energy Conservation Through More Efficient Lighting," *Science* 226:435-436 (1984).

(Continued)

*Primary Examiner* — Mary Ellen Bowman
(74) *Attorney, Agent, or Firm* — Cyrus F. Bharucha; G+J Law Group PLLC

(57) ABSTRACT

Described herein is a mercury sample that has an isotopic composition that differs from the naturally occurring distribution of isotopes. In various configurations of an isotopically tailored mercury sample, the fraction of one or more isotopes is increased or decreased with respect to the natural fraction(s). A example of a lighting device comprises an envelope, a buffer gas enclosed within the envelope, a isotopically tailored sample of mercury vapor, and a current injection mechanism configured to excite the mercury vapor to emit light. In various configurations, the lighting device emits radiation at a wavelength of 254 nm and/or at a wavelength of 185 nm. In various configurations, the lighting device envelope includes a fluorescent coating that is excited by ultraviolet (UV) light emitted by the mercury vapor. In various configurations, the lighting device provides improved efficiency as compared to lamps employing mercury with a naturally occurring isotope distribution.

28 Claims, 3 Drawing Sheets

(56) References Cited

U.S. PATENT DOCUMENTS

| | | | | |
|---|---|---|---|---|
| 5,100,803 | A | 3/1992 | Grossman et al. | |
| 8,339,043 | B1 * | 12/2012 | Anderson | 313/639 |
| 8,672,138 | B2 | 3/2014 | Raizen et al. | |

OTHER PUBLICATIONS

J. B. Anderson, J. Maya, M. W. Grossman, R. Lagushenko, and J. F. Waymouth, "Monte Carlo treatment of resonance-radiation imprisonment in fluorescent lamps," *Phys. Rev. A*, 31:2968-2975 (1985).
M. W. Grossman, R. Lagushenko, and J. Maya, "Isotope effects in low-pressure Hg-rare-gas discharges," *Phys. Rev. A*, 34:4094-4102 (1986).
K. L. Menningen and J. E. Lawler, "Radiation trapping of the Hg 185 nm resonance line," *J. Appl. Phys.* 88:3190-3197 (2000).
"UV lamps for germicidal applications," GE Lighting, brochure, 3 pages (2006).
J. Paul, Y. Kaneda, T. L. Wang, C. Lytle, J. V. Moloney, R. J. Jones, "Doppler-free spectroscopy of mercury at 253.7 nm using a high-power, frequency-quadrupled, optically pumped external-cavity semiconductor laser," *Opt. Lett.*, 36:61-63 (2011).
Mark G. Raizen and Bruce Klappauf, "Magnetically activated and guided isotope separation," *New J. Phys.*, 14:023059, pp. 1-12 (2012).
James E. Lawler and Mark G. Raizen, "Enhanced escape rate for Hg 254 nm resonance radiation in fluorescent lamps," *J. Phys. D: Appl. Phys.* 46:415204, pp. 1-8 (2013).
"Isotopes of mercury," *Wikipedia*, 5 pages (2013).
"Ultraviolet technology," LIT Company, pages from web site at lit-uv.com,3 pages (2013).
"Fluorescent lamp," *Wikipedia*, 26 pages (2013).
"GE Germicidal Lamps," brochure, 2 pages (obtained Apr. 2014).
"Germicidal T6 Biax," GE Lighting, brochure, 3 pages (obtained Apr. 2014).
"Germicidal T6 Biax," General Electric Company, specification sheet, 1 page (2014) (obtained Apr. 2014).
I. Peterson, "Lighting the Way to a Stronger Glow," *Science News*, 126:262 (Oct. 27, 1984).
International Search Report and Written Opinion from International (PCT) Patent Application No. PCT/US2014/037878, 7 pages, Sep. 9, 2014.

* cited by examiner

COMPOSITIONS OF MERCURY ISOTOPES FOR LIGHTING

This application claims the benefit under 35 U.S.C. §119 (e) of U.S. Provisional Patent Application No. 61/822,897, filed on May 13, 2013, titled "Compositions of Mercury Isotopes for Fluorescent Lighting," and naming Mark G. Raizen and James E. Lawler as inventors. The aforementioned application is hereby incorporated by reference herein.

FIELD OF THE INVENTION

The present disclosure relates in general to illumination technology and in particular to the use of mercury vapors in lighting.

BACKGROUND

Fluorescent lamps are used throughout the world as a popular choice for lighting. In many situations, fluorescent lamps benefit consumers with lower power consumption as compared to alternatives such as incandescent lighting. This factor reduces operating costs and can be beneficial for environmental preservation. Other alternatives, such as solid-state lighting, generally have a higher cost of manufacture and initial implementation. Until costs are significantly reduced for those alternatives, which is expected to take a number of technology generations (several decades), fluorescent lighting will continue to be the primary choice for many widespread lighting applications.

Fluorescent lamp technology enjoys a long history of innovations that have reduced manufacturing costs and operating costs. Nonetheless, further cost reductions can be beneficial. For example, it would be helpful to have technologies that can reduce the long-term operating cost of lighting devices.

BRIEF DESCRIPTION OF THE DRAWINGS

The benefits, features, and advantages of the present disclosure will become better understood with regard to the following description, and accompanying drawings where.

DETAILED DESCRIPTION

Figure 1:
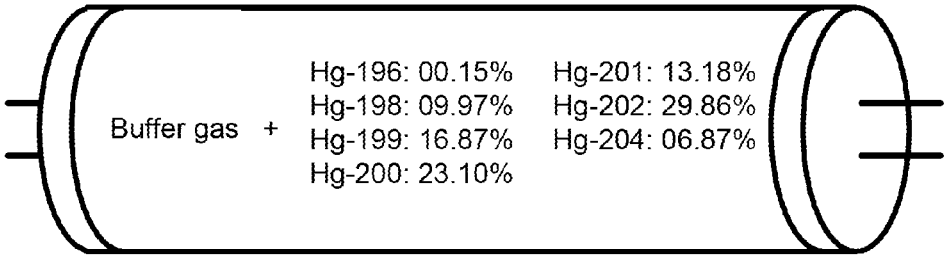
FIG. 1 depicts an example of a fluorescent lamp that uses a naturally occurring sample of mercury as the excitation material.

FIG. 1 depicts an example of a fluorescent lamp that uses a naturally occurring sample of mercury as the excitation material. Fluorescent lamps typically use a small amount (e.g., ~0.05 milligrams) of mercury vapor, typically in a glass tube with a buffer gas. Under operating conditions, an electric current through the tube excites the mercury atoms, which then emit photons. The photons include ultraviolet (UV) photons with a wavelength of 254 nm and photons with a wavelength of 185 nm. The photons propagate within the tubular lamp envelope, through the buffer gas/mercury vapor mix, before they reach the envelope of the glass tube. A fluorescent coating on the inner wall of the glass tube is excited by the photons and radiates a spectrum of visible light.

The mercury vapor in the lamp envelope is partly opaque to the photons. Thus, a photon emitted by a mercury atom can be reabsorbed by adjacent atoms, leading to a much longer effective lifetime of the photon before it can reach the fluorescent coating. Along the way, collisions between neighboring atoms may place an excited-state atom into a non-radiating state. These quenching collisions effectively remove the photon from the light-generating process. The result is a lowered escape rate of photons; photons lost due to inter-atomic collisions do not reach the phosphor coating on inner wall of the lamp envelope. Such collisions quench radiating states, which amount to a loss of efficiency in the overall conversion of electrical power to illumination light.

One approach to reducing quenching losses is to modify the fractional amounts of mercury isotopes in the vapor. Mercury has seven naturally occurring isotopes, including a small amount of mercury-196. Adding more of the rare Hg-196 isotope to natural mercury enhances the radiation escape rate from an arc discharge. This enhancement can yield higher efficiency, with a modest improvement of up to approximately 7%.

This effect arises because changes in the isotopic composition can, in effect, lead to a redistribution in the energy spectrum of photons that are emitted from the mercury vapor. (See, e.g., J. Maya, M. W. Grossman, R. Lagushenko, and J. F. Waymouth, "Energy Conservation Through More Efficient Lighting," *Science* 226, 435-436 (1984); J. B. Anderson, J. Maya, M. W. Grossman, R. Lagushenko, and J. F. Waymouth, "Monte Carlo treatment of resonance-radiation imprisonment in fluorescent lamps," *Phys. Rev. A,* 31:2968-2975 (1985) [Anderson-1985]; M. W. Grossman, R. Lagushenko, and J. Maya, "Isotope effects in low-pressure Hg—rare-gas discharges," *Phys. Rev. A,* 34:4094-4102 (1986) [Grossman-1986]; U.S. Pat. No. 4,379,252 issued to Work et al.; U.S. Pat. No. 4,527,086 issued to Maya.)

Figure 2:
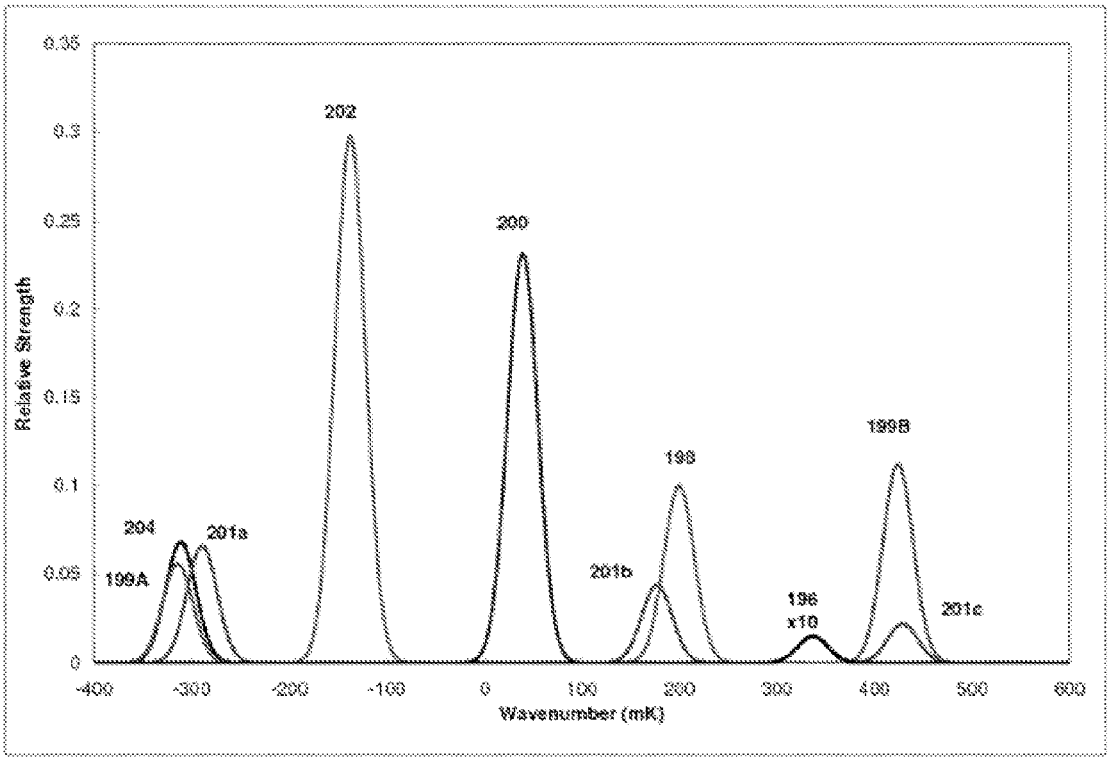
FIG. 2 shows an example of a high-resolution spectrum, plotting the isotopic component pattern of the 253.7 nm Hg line with Gaussian line shapes (Doppler broadened at 335 K) for each isotopic component. The scarce $^{196}$Hg isotopic component is scaled by ×10 to make it visible in this view.

This effect can be understood roughly from the spectrum depicted in FIG. 2. This figure shows an example of a detailed spectrum, plotting the component pattern of the 253.7 nm mercury line with Gaussian line shapes (Doppler broadened at 335 K) for each isotopic component in a naturally occurring sample of mercury vapor. The plot has no optical depth corrections and natural isotopic abundances are used except that the rare $^{196}$Hg isotopic component is scaled by ×10 to make it visible in this view. The plot shows a substantially higher relative strength for absorption and emission of photons by $^{202}$Hg and $^{200}$Hg at the main peaks—which have significantly higher abundances in naturally occurring mercury—as compared to the strengths for other isotopes such as $^{196}$Hg and $^{204}$Hg—which have significantly lower abundances in naturally occurring mercury. This significant variation in relative strength at different wavenumbers (corresponding to different isotopes) leads to greater quenching among photons radiated and absorbed by some of the isotopes, and less quenching among photons radiated and absorbed by others of the isotopes. By changing the relative abundance of the various isotopes in a mercury vapor, the relative strengths in this spectrum can be adjusted, leading to a more balanced probability of quenching among the photons propagating through the vapor. The adjusted set of quenching rates can lead to an increased total number of photons that survive to reach the fluorescent coating.

Earlier observations on the prospect of enhanced efficiency, e.g., Anderson-1985, have not led to practical implementations. One factor has been that the expected improvement in efficiency from those observations is comparatively modest. Another factor is that many methods for isotopic enrichment of mercury are comparatively expensive.

We have now extended the earlier analyses. The calculations discussed herein encompass more than the addition of Hg-196. Our calculations can be used to model a mercury vapor with any composition of the seven mercury isotopes. These calculations have allowed us to find mixtures of mercury isotopes that can provide an enhancement of the 254 nm UV escape rate of up to approximately 16% (e.g., approximately 8%, 9%, 10%, 11%, 12%, 13%, 14%, 15%, 16%) or more (e.g. approximately 17%, 18%, 19%, 20%) in the escape rate of 254 nm radiation. Described herein are various isotopic compositions that can be used to achieve these escape rates. The enhanced escape rate is sufficiently large that a re-optimization of fluorescent lamp operating conditions including Hg density, buffer gas pressure, and discharge current can be considered. For example, the compositions with enhanced escape rates may lead, in some situations, to fluorescent lamps that have higher luminous efficacy than prior technologies.

Figure 3:
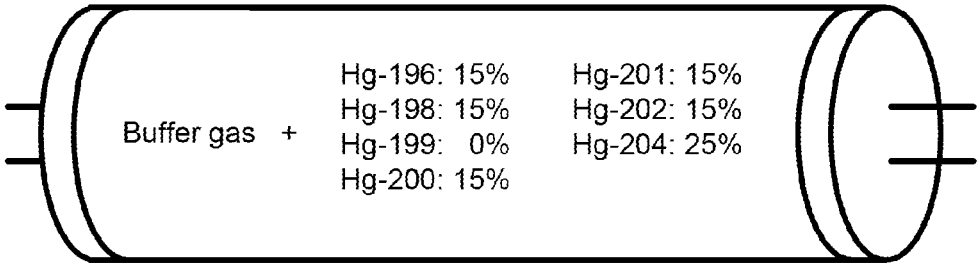
FIG. 3 depicts an example of a fluorescent lamp that uses an isotopically tailored sample of mercury as the excitation material.

FIG. 3 depicts one example of a fluorescent lamp that uses an isotopically tailored sample of mercury as the excitation material. In various situations, the isotopic compositions described herein may be used for drop-in replacement lamps that provide enhanced lighting and/or lower power consumption than existing fluorescent tubes. These considerations are relevant to situations where fluorescent lighting is commonly used, such as offices, schools, factories, retail stores, and other nonresidential indoor lighting applications. Fluorescent lighting is the technology of choice for almost all non-residential indoor lighting. Fluorescent lamps are also used in residential applications, and are growing with the popularity of compact fluorescent lamps.

The calculations presented herein are based on a transport model of photons traversing a mercury vapor. Most of the input energy to the positive column of a fluorescent lamp discharge reaches the phosphor coated tube wall as 254 nm resonance radiation from the 6s6p $^3P_1$ to 6s$^2$ $^1S_0$ ground level of Hg. This spin-forbidden transition, although two orders of magnitude weaker than the spin-allowed "true" 6s6p $^1P_1$ to 6s$^2$ $^1S_0$ resonance at 185 nm, dominates the power balance of the plasma because of the much lower excitation energy of the 6s6p $^3P_1$ level. Mercury is a sufficiently heavy atom that relativistic effects lead to a partial breakdown of Russell-Saunders (LS) coupling and thus the 6s6p $^3P_1$ level has a small admixture of 6s6p $^1P_1$ character.

The 254 nm transition is sufficiently strong that 10's to 100's of absorption-emission cycles occur while a 254 nm resonance photon migrates to the lamp wall in the commonly used T12 or T8 lamps. Reducing the number of these absorption-emission cycles, which trap the propagating photons, can help avoid quenching losses. This radiation trapping phenomenon is analogous to particle diffusion, but it is correctly modeled using an integral equation rather than a differential equation of a diffusion model. Various considerations relevant to such modeling can be found in U.S. Provisional Patent Application No. 61/822,897, filed on May 13, 2013, titled "Compositions of Mercury Isotopes for Fluorescent Lighting," and naming Mark G. Raizen and James E. Lawler as inventors [Raizen-897]; and in James E. Lawler and Mark G. Raizen, "Enhanced escape rate for Hg 254 nm resonance radiation in fluorescent lamps," *J. Phys. D: Appl. Phys.* 46:415204 (Sep. 23, 2013) [Lawler-2013]. Both of these documents are hereby incorporated by reference herein.

Table 1 presents escape rates that we have found for 254 nm Hg I resonance radiation for various combinations of mercury isotopes in a Hg/Ar gas mixture for lamps with various tubular geometries. The table includes isotopic mixes that yield UV resonance radiation escape rates that are 16% to 21% or more higher than that of mercury with a naturally occurring isotope mixture.

Each row in Table 1 represents a separate simulation. For each row, the left-side columns of Table 1 indicate the mole fraction (percentage) of each of the seven naturally occurring isotopes of mercury that were used for that calculation. The right three columns show the results for three examples of tube diameters and buffer gas pressures. These three examples are named "Standard," "Electrodeless," and "Miniature" lamps in this table, and are further discussed below. The results for these three examples are the calculated escape rates given in terms of $\tau_\nu$, which is the vacuum radiative lifetime of the 6s6p $^3P_1$ level in mercury (125 ns).

The data for the Standard lamps are based on a model using a 38 mm diameter tube, an argon buffer gas with a density of $8.10\times10^{16}/cm^3$ (2.5 Torr at 293 K fill temperature), a mercury density of $1.75\times10^{14}/cm^3$ (from a cold spot temperature of ~40° C.), and an operating gas temperature of 335 K. The data for the Electrodeless lamps are based on a model using a 50 mm diameter tube, an argon buffer-gas with a density of $9.88\times10^{15}/cm^3$ (0.30 Torr at 293 K fill temperature), a mercury density of $1.88\times10^{14}/cm^3$, and an operating gas temperature of 335 K. The data for the Miniature lamps are based on a model using a 6.4 mm diameter tube, an argon buffer-gas with a density of $1.65\times10^{17}/cm^3$ (5 Torr at 293 K fill temperature), a mercury density of $1.88\times10^{14}/cm^3$, and an operating gas temperature of 335 K.

The first row in Table 1 (row #1) shows a calculation of escape rates for lamps using the naturally occurring isotopic mix of mercury (0.15% Hg-196, 9.97% Hg-198, 16.87% Hg-199, 23.10% Hg-200, 13.18% Hg-201, 29.86% Hg-202, 6.87% Hg-204). Row#2 shows the calculated escape rates using a modified isotopic mix of mercury. In this calculation, an additional amount of the rarest isotope, Hg-196, has been added to increase its fraction to 4%, with the other six isotopes otherwise remaining in proportion to their natural abundances. The results shown in row #2 match previous predictions (e.g., Anderson-1985 cited above) that such an addition of Hg-196 leads to increased escape rates. This effect is similarly seen in row #3—row #6, which represent mercury mixtures that have 2%, 6%, 8%, and 10% fractions of Hg-196.

The calculations in Table 1 go beyond the addition of a single isotope. In subsequent rows, the amount of all seven natural isotopes are varied, and the resulting escape rates are shown. The various calculations in the rows are further discussed below and in Raizen-897 and Lawler-2013, cited above. These data show that escape rates can be enhanced beyond the values that can be achieved merely by the addition of Hg-196.

For example, row #40 represents a mercury mixture with 15% Hg-196, 15% Hg-198, 15% Hg-200, 15% Hg-201, 15% Hg-202, 25% Hg-204, and no Hg-199. This isotopic composition leads to an escape rate for the Standard lamp model that is approximately 16%-17% higher than the escape rate with naturally occurring mercury. Similarly, this composition leads to an escape rate for the Electrodeless lamp model that is approximately 20%-21% higher than the escape rate with naturally occurring mercury. (The results are also approximately 3%-5% better than the rates achieved simply by the addition of Hg-196 in row #5). The example in row #41 shows similar results (with 14.5% Hg-196, 14.5% Hg-198, 14.5% Hg-200, 15% Hg-201, 14.5% Hg-202, 27% Hg-204, and no Hg-199).

TABLE 1

Escape rates of 254 nm Hg I resonance radiation for various isotopic mixes.

| | Hg 196 | Hg 198 | Hg 199 | Hg 200 | Hg 201 | Hg 202 | Hg 204 | Escape Rate (Standard lamp) | Escape Rate (Electrode-less lamp) | Escape Rate (Miniature lamp) |
|---|---|---|---|---|---|---|---|---|---|---|
| 1 | 00.15 | 09.97 | 16.87 | 23.10 | 13.18 | 29.86 | 06.87 | 1/(54.2 τv) ± 0.09% | 1/(99.9 τv) ± 0.06% | 1/(9.15 τv) ± 0.07% |
| 2 | 04.00 | 09.59 | 16.22 | 22.21 | 12.67 | 28.71 | 06.61 | 1/(49.3 τv) ± 0.28% | 1/(87.9 τv) ± 0.06% | 1/(8.50 τv) ± 0.06% |
| 3 | 02.00 | 09.79 | 16.56 | 22.67 | 12.94 | 29.31 | 06.74 | 1/(50.8 τv) ± 0.28% | 1/(91.2 τv) ± 0.05% | 1/(8.81 τv) ± 0.06% |
| 4 | 06.00 | 09.39 | 15.88 | 21.75 | 12.41 | 28.11 | 06.47 | 1/(48.7 τv) ± 0.25% | 1/(86.7 τv) ± 0.05% | 1/(8.26 τv) ± 0.06% |
| 5 | 08.00 | 09.19 | 15.54 | 21.28 | 12.14 | 27.51 | 06.33 | 1/(48.3 τv) ± 0.23% | 1/(86.3 τv) ± 0.05% | 1/(8.08 τv) ± 0.06% |
| 6 | 10.00 | 08.99 | 15.21 | 20.82 | 11.88 | 26.91 | 06.19 | 1/(48.3 τv) ± 0.08% | 1/(86.2 τv) ± 0.06% | 1/(7.94 τv) ± 0.06% |
| 7 | 06.00 | 09.39 | 15.88 | 24.93 | 12.41 | 24.93 | 06.47 | 1/(48.7 τv) ± 0.24% | 1/(86.7 τv) ± 0.05% | 1/(8.22 τv) ± 0.06% |
| 8 | 08.00 | 14.00 | 14.64 | 20.05 | 11.44 | 25.91 | 05.96 | 1/(48.2 τv) ± 0.25% | 1/(86.2 τv) ± 0.07% | 1/(7.95 τv) ± 0.06% |
| 9 | 08.00 | 06.00 | 16.14 | 22.10 | 12.61 | 28.57 | 06.57 | 1/(48.4 τv) ± 0.25% | 1/(86.2 τv) ± 0.07% | 1/(8.24 τv) ± 0.06% |
| 10 | 0 | 0 | 0 | 0 | 100 | 0 | 0 | 1/(80.3 τv) ± 0.28% | 1/(177.7 τv) ± .07% | 1/(14.75 τv) ± 0.04% |
| 11 | 0 | 0 | 0 | 0 | 24.00 | 0 | 76.00 | 1/(77.5 τv) ± 0.27% | 1/(159.0 τv) ± 0.07% | 1/(17.50 τv) ± 0.04% |
| 12 | 0 | 0 | 0 | 0 | 18.00 | 0 | 82.00 | 1/(77.3 τv) ± 0.13% | 1/(157.3 τv) ± 0.07% | 1/(18.99 τv) ± 0.04% |
| 13 | 0 | 0 | 0 | 0 | 12.00 | 0 | 88.00 | 1/(77.9 τv) ± 0.23% | 1/(157.4 τv) ± 0.07% | 1/(21.50 τv) ± 0.05% |
| 14 | 0 | 0 | 0 | 0 | 06.00 | 0 | 94.00 | 1/(82.9 τv) ± 0.07% | 1/(167.6 τv) ± 0.08% | 1/(26.29 τv) ± 0.05% |
| 15 | 0 | 0 | 0 | 0 | 03.00 | 0 | 97.00 | 1/(94.2 τv) ± 0.19% | 1/(196.8 τv) ± 0.08% | 1/(30.60 τv) ± 0.06% |
| 16 | 0 | 0 | 0 | 0 | 01.50 | 0 | 98.50 | 1/(109.8 τv) ± 0.13% | 1/(247.6 τv) ± 0.06% | 1/(33.74 τv) ± 0.06% |
| 17 | 0 | 0 | 0 | 0 | 0 | 100 | 0 | 1/(154.8 τv) ± 0.27% | 1/(490.7 τv) ± 0.09% | 1/(37.96 τv) ± 0.06% |
| 18 | 0 | 0 | 0 | 50.00 | 0 | 50.00 | 0 | 1/(112.5 τv) ± 0.23% | 1/(271.5 τv) ± 0.07% | 1/(21.89 τv) ± 0.05% |
| 19 | 0 | 33.33 | 0 | 33.33 | 0 | 33.33 | 0 | 1/(85.9 τv) ± 0.21% | 1/(182.8 τv) ± 0.04% | 1/(15.07 τv) ± 0.04% |
| 20 | 0 | 25.00 | 0 | 25.00 | 0 | 25.00 | 25.00 | 1/(68.0 τv) ± 0.19% | 1/(135.6 τv) ± 0.03% | 1/(11.39 τv) ± 0.03% |
| 21 | 20.00 | 20.00 | 0 | 20.00 | 0 | 20.00 | 20.00 | 1/(56.4 τv) ± 0.18% | 1/(107.1 τv) ± 0.03% | 1/(9.17 τv) ± 0.03% |
| 22 | 19.00 | 19.00 | 0 | 19.00 | 05.00 | 19.00 | 19.00 | 1/(48.8 τv) ± 0.09% | 1/(86.4 τv) ± 0.08% | 1/(8.59 τv) ± 0.04% |
| 23 | 18.50 | 18.50 | 0 | 18.50 | 07.50 | 18.50 | 18.50 | 1/(47.8 τv) ± 0.26% | 1/(84.4 τv) ± 0.08% | 1/(8.37 τv) ± 0.04% |
| 24 | 18.00 | 18.00 | 0 | 18.00 | 10.00 | 18.00 | 18.00 | 1/(47.2 τv) ± 0.22% | 1/(83.6 τv) ± 0.08% | 1/(8.19 τv) ± 0.04% |
| 25 | 17.50 | 17.50 | 0 | 17.50 | 12.50 | 17.50 | 17.50 | 1/(47.0 τv) ± 0.26% | 1/(83.3 τv) ± 0.03% | 1/(8.04 τv) ± 0.03% |
| 26 | 17.00 | 17.00 | 0 | 17.00 | 15.00 | 17.00 | 17.00 | 1/(46.8 τv) ± 0.25% | 1/(83.2 τv) ± 0.03% | 1/(7.92 τv) ± 0.03% |
| 27 | 16.50 | 16.50 | 0 | 16.50 | 17.50 | 16.50 | 16.50 | 1/(46.8 τv) ± 0.24% | 1/(83.2 τv) ± 0.07% | 1/(7.82 τv) ± 0.05% |
| 28 | 16.00 | 16.00 | 0 | 16.00 | 20.00 | 16.00 | 16.00 | 1/(46.9 τv) ± 0.08% | 1/(83.3 τv) ± 0.07% | 1/(7.74 τv) ± 0.05% |
| 29 | 15.50 | 15.50 | 0 | 15.50 | 22.50 | 15.50 | 15.50 | 1/(46.8 τv) ± 0.21% | 1/(83.4 τv) ± 0.07% | 1/(7.69 τv) ± 0.05% |
| 30 | 17.00 | 17.00 | 05.00 | 17.00 | 10.00 | 17.00 | 17.00 | 1/(47.6 τv) ± 0.09% | 1/(84.9 τv) ± 0.03% | 1/(7.74 τv) ± 0.03% |
| 31 | 16.00 | 16.00 | 05.00 | 16.00 | 15.00 | 16.00 | 16.00 | 1/(47.4 τv) ± 0.22% | 1/(84.8 τv) ± 0.03% | 1/(7.60 τv) ± 0.03% |
| 32 | 18.00 | 18.00 | 0 | 15.00 | 16.00 | 15.00 | 18.00 | 1/(46.8 τv) ± 0.15% | 1/(83.2 τv) ± 0.03% | 1/(7.93 τv) ± 0.03% |
| 33 | 16.00 | 16.00 | 0 | 19.00 | 14.00 | 19.00 | 16.00 | 1/(47.0 τv) ± 0.26% | 1/(83.3 τv) ± 0.03% | 1/(7.97 τv) ± 0.03% |
| 34 | 18.00 | 13.00 | 0 | 18.00 | 15.00 | 18.00 | 18.00 | 1/(46.9 τv) ± 0.13% | 1/(83.3 τv) ± 0.03% | 1/(7.92 τv) ± 0.03% |
| 35 | 16.00 | 21.00 | 0 | 16.00 | 15.00 | 16.00 | 16.00 | 1/(46.9 τv) ± 0.24% | 1/(83.1 τv) ± 0.03% | 1/(7.99 τv) ± 0.03% |
| 36 | 18.00 | 18.00 | 0 | 18.00 | 15.00 | 18.00 | 13.00 | 1/(47.2 τv) ± 0.04% | 1/(83.4 τv) ± 0.09% | 1/(7.93 τv) ± 0.04% |

TABLE 1-continued

Escape rates of 254 nm Hg I resonance radiation for various isotopic mixes.

| | Hg 196 | Hg 198 | Hg 199 | Hg 200 | Hg 201 | Hg 202 | Hg 204 | Escape Rate (Standard lamp) | Escape Rate (Electrode-less lamp) | Escape Rate (Miniature lamp) |
|---|---|---|---|---|---|---|---|---|---|---|
| 37 | 16.50 | 16.50 | 0 | 16.50 | 15.00 | 16.50 | 19.00 | 1/(46.8 τv) ± 0.09% | 1/(83.1 τv) ± 0.09% | 1/(7.94 τv) ± 0.04% |
| 38 | 16.00 | 16.00 | 0 | 16.00 | 15.00 | 16.00 | 21.00 | 1/(46.7 τv) ± 0.13% | 1/(82.9 τv) ± 0.09% | 1/(7.97 τv) ± 0.04% |
| 39 | 15.50 | 15.50 | 0 | 15.50 | 15.00 | 15.50 | 23.00 | 1/(46.6 τv) ± 0.09% | 1/(82.9 τv) ± 0.06% | 1/(8.02 τv) ± 0.03% |
| 40 | 15.00 | 15.00 | 0 | 15.00 | 15.00 | 15.00 | 25.00 | 1/(46.5 τv) ± 0.15% | 1/(82.8 τv) ± 0.06% | 1/(8.09 τv) ± 0.03% |
| 41 | 14.50 | 14.50 | 0 | 14.50 | 15.00 | 14.50 | 27.00 | 1/(46.6 τv) ± 0.15% | 1/(82.7 τv) ± 0.06% | 1/(8.17 τv) ± 0.03% |

The parameter space of possible isotopic mixes is six dimensional and thus a comprehensive search is challenging. Table 1 therefore presents a somewhat selective exploration of the isotopic parameter space.

The simulations in rows #3-6 of the Standard-lamp column confirm the saturation of the escape rate found in previous predictions (e.g., Anderson-1985 cited above) as the $^{196}$Hg fraction is varied from its low natural abundance to 0.10.

The relative strengths in FIG. 2 suggest that the fractions of the even isotopes, particularly $^{202}$Hg, could be better balanced. The simulations in rows #7-9 explore the effect of better balancing the even isotopes. FIG. 2 shows that the $^{202}$Hg and $^{200}$Hg components do not overlap each other or hyperfine components of odd isotopes. As indicated by a comparison between row #4 and row #7, the effect of balancing the concentration of these two isotopes is limited. FIG. 2 reveals that the under-abundant (natural abundance ~0.0997) even isotope $^{198}$Hg component overlaps with the odd isotope hyperfine component 201b. As indicated by a comparison between row #5 and row #8, the effect of boosting the concentration of $^{198}$Hg is limited. A comparison between row #5 and row #9 reveals that the effect of decreasing the concentration of $^{198}$Hg is also limited.

The simulations in rows #10-16 explore isotopic mixes of $^{201}$Hg and $^{204}$Hg. The 201a hyperfine component is the strongest of the three components from this odd isotope. The overlap of this hyperfine component with the $^{204}$Hg component, and a rapid randomization of the upper $^{201}$Hg hyperfine levels suggests that energy absorbed in the excitation of the 6s6p $^3P_1$ level by inelastic collisions of electrons with $^{204}$Hg atoms might be transferred to $^{201}$Hg via both radiation and resonance collisions and then rapidly escape via radiative emission at the 201b and 201c components. This scheme does not lead to a substantial improvement because the transfer from $^{204}$Hg to $^{201}$Hg is not sufficiently fast.

The dependence of the escape rate on opacity is illustrated by simulations in rows #17-21. The even isotopes are added one at a time in these simulations and their factions in the mix are maintained equal. The decrease in opacity with the addition of each even isotope yields a increase in the escape rate, but the effect is not linear.

The simulations in rows #22-29 maintained balanced concentrations of the five even isotopes while increasing the concentration of the $^{201}$Hg odd isotope from 0.05 to 0.225. The simulations in rows #26 and #27 yield radiation escape rates higher than can be achieved by simply adding $^{196}$Hg as shown in rows #2-6. Subsequent simulations use these isotopic mixes as starting points for further modification. These eight simulations did not include any $^{199}$Hg and it is thus interesting to explore the effect of reintroducing this odd isotope. The 199A component overlaps with the 201a component and the 199B component overlaps the 201c component. Addition of $^{199}$Hg does provide some independent control over relative intensities of the combined overlapping components. However, the simulations in rows #30 and #31 indicate that the reintroduction of $^{199}$Hg is of limited effect.

As mentioned earlier the $^{202}$Hg and $^{200}$Hg components do not overlap each other or odd isotope hyperfine components. The simulations in rows #32 and #33 explored the effect of raising and lower concentrations of these two even isotopes in comparison to the other even isotopes and $^{201}$Hg. No substantial increase in the radiation escape rate was found compared to the simulation of rows #26 and #27.

The 254 nm line component of the $^{198}$Hg isotope overlaps the 201b component. Simulations reported in rows #34 and #35 explored the effect of varying the $^{198}$Hg concentration above and below its value in the simulations of rows #26 and #27. Changes in the $^{198}$Hg concentration had limited effect.

The 254 nm line component of the $^{204}$Hg isotope overlaps the 201a and 199A components. Simulations reported in rows #36-#41 explored the effect of varying the $^{204}$Hg concentration above and below its value in the simulations of rows #26 and #27. Changes in the $^{204}$Hg concentration have a small beneficial effect on the radiation escape rate.

The column with escape rates for the Standard lamp shows that the simulation in row #40 yields the best result for this type of lamp, with an escape rate 117% of that in row #1 for a natural isotopic mix and 104% of that in rows #5 and #6 for an optimum addition of the $^{196}$Hg isotope to a natural isotopic mix. The tailored isotopic composition from the simulation in row #40 is depicted in the example of FIG. 3.

The column with escape rates for the Electrodeless lamp shows that the simulation in row #41 yields the best result for this type of lamp, with an escape rate 121% of that in row #1 for a natural isotopic mix and 104% of that in row #6 for an optimum addition of the $^{196}$Hg isotope to a natural isotopic mix. Electrodeless lamps such as the ICETRON/ENDURA lamps by Osram Sylvania Inc. operate at appreciably higher current (~7 A) than various electroded fluorescent lamps. This higher current helps optimize the lamp efficiency by lowering losses in the ferrite cores used to couple radio frequency power into the lamp discharge. The larger diameter of these lamps results in generally lower escape rates for Hg 254 nm resonance radiation. The higher power density may result in higher rates for inelastic and super-elastic electron Hg atom collisions. For example, the ratio of Hg resonance radiation at 185 nm to that at 254 nm may be higher in such discharges than in Standard fluorescent lamps (K. L. Menningen and J. E.

Lawler, "Radiation trapping of the Hg 185 nm resonance line," *J. Appl. Phys.* 88:3190 (2000), which is hereby incorporated by reference). The increase in the ratio of 185 nm to 254 nm radiation reaching the phosphor degrades lamp performance because of the larger Stokes shift to the visible and because the more energetic 185 nm photons tend to shorten the phosphor life. A larger diameter, higher power density discharges is one test case for a customized Hg isotopic mix. The overall improvement in lamp efficacy may be higher in larger diameter, high power density lamps than the 4% efficacy improvement found in Grossman-1986 for a Standard electroded T12 lamp.

The column with escape rates for the Miniature lamps shows that the simulation in row #29 yields the best result for this type of lamp, with an escape rate 119% of that in row #1 for a natural isotopic mix and 103% of that in row #6 for an optimum addition of the $^{196}$Hg isotope to a natural isotopic mix. The Miniature lamps are available from many manufacturers and such products are often used for back lighting displays and in other applications where space is limited. These small diameter T2 lamps have generally higher escape rates for Hg 254 nm resonance radiation than T8, T12 and large diameter Electrodeless (T16 or T17) lamps. Small diameter lamps due tend to operate at higher power density than Standard 4 ft. fluorescent lamps used for general illumination. Many compact fluorescent lamps have tube diameters similar to T2 lamps or between that of T2 lamps and the widely used Standard (T12 or T8) 4 ft. long tubular lamps. The lower opacity of the small diameter lamps shifts the optimum escape rate for Hg 254 nm resonance radiation to somewhat different isotopic mix.

These discoveries are timely in view of recent developments in techniques for isotope separation. See, e.g., U.S. patent application Ser. No. 13/691,723 (now U.S. Pat. No. 8,672,138), filed on Nov. 30, 2012, titled "Isotope Separation by Magnetic Activation and Separation," and naming Mark G. Raizen and Bruce G. Klappauf as inventors; and Mark G. Raizen and Bruce Klappauf, "Magnetically activated and guided isotope separation," 2012 *New J. Phys.* 14:023059, which are hereby incorporated by reference herein. Such developments may be used to help in the production of the desired isotopic compositions.

In one implementation, a customized mixture of mercury isotopes can be prepared starting with an effusive beam of mercury, generated at a source temperature slightly above room temperature, with a low kinetic of the mercury atoms. The atoms in the effusive beam are optically pumped with isotope-specific wavelengths of light. The optical pumping provides one or more selected isotopes with a temporary magnetic moment. The isotopes in the effusive beam are then separated by being propagated through magnetic fields from, for example, an array of curved magnet surfaces.

In various implementations, the effusive beam is aimed into a magnetic field in a curved guide without a direct line of sight between the source and collector. The 6 $s^2$ $^1S$ ground state of mercury has J=0, so except for the negligible nuclear spin of odd isotopes, is non-magnetic. Without optical pumping to a J≠0 level, these atoms cannot make it through such a curved guide from source to collector without hitting walls of the guide. The collector surface(s) and/or guide walls can be maintained just above the melting point of mercury (234.32 K), so that atoms will stick to a liner on the walls. At this temperature the atoms will condense and flow downwards where they can be collected, instead of accumulating.

Figure 4:
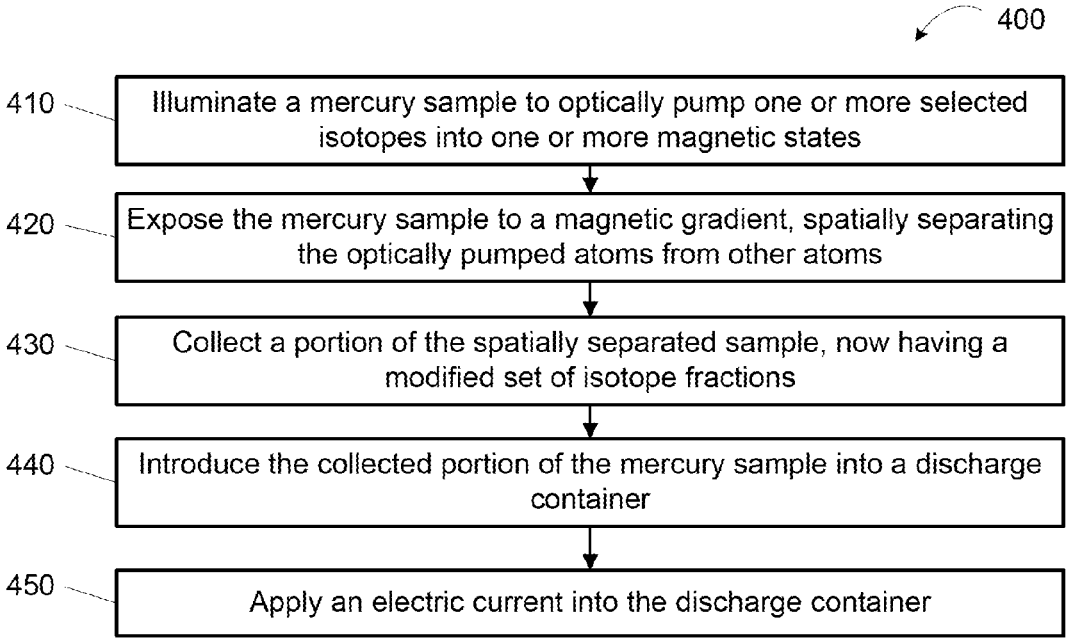
FIG. 4 shows an example of a method for preparing and operating a fluorescent lamp with an isotopically tailored sample of mercury as the excitation material.

FIG. 4 shows an example of a method 400 for preparing and operating a fluorescent lamp with an isotopically tailored sample of mercury as the excitation material. In act 410, a sample of mercury vapor is illuminated with appropriate laser beams (e.g., with appropriate wavelengths, intensities, polarizations) to optically pump one or more selected isotopes into one or more target magnetic states. The target magnetic states are selected so that the optically pumped atoms can be deflected in a desired manner while passing through a magnetic field gradient. For example, the target magnetic states may be one or more magnetic states in which the atoms are repelled by magnetic fields, so that they can be suitably deflected and navigate though a curved guide without being blocked by the walls of the guide. (In other examples, the target magnetic states are one or more magnetic states in which the atoms are attracted magnetic fields, e.g., so that they can impact and be collected from a curved guide, or so that they can navigate through an alternately curved guide.)

In act 420, the sample of mercury sample is exposed to a magnetic gradient. For example, the sample can be projected in an atomic beam through an optical interaction region (act 410) and then into a magnetic-field interaction region (act 420). Because of optical pumping in act 410, the magnetic gradient imparts different deflections to the atoms that have ended up in different magnetic states. For example, atoms in a $m_J$=−2 magnetic state will be deflected in one direction; atoms in a $m_J$=−1 magnetic state will be deflected the same direction but to a lesser degree; atoms in a $m_J$=0 magnetic state will not be deflected by the magnetic field; atoms in a $m_J$=+1 magnetic state will be deflected in an opposite direction; atoms in a $m_J$=+2 magnetic state will also be deflected that opposite direction, and to a greater degree. The different degrees of deflection lead to spatial separation of different fractions of the mercury sample.

In act 430, one or more portions of the spatially separated sample are harvested. The harvesting can take the form of collecting those atoms that successfully navigate through a curved guide surrounding the magnetic field from act 420. Alternatively, the harvesting can take the form of gathering atoms from one or more the walls of a guide from some other blocking element, after those desired atoms have impacted onto the blocking element. Since the portions were spatially separated based on their magnetic states (act 420), and those states were achieved though isotope-selective optical pumping (act 410), the harvested atoms have a modified isotopic composition. In various implementations of method 400, the harvested atoms are isotopically pure. In other implementations, the harvested atoms have a desired isotopic composition that is suitable for use in a gas-discharge lamp (for example, as specified by a calculation such as illustrated by one of the rows from Table 1, or as specified by a related calculation). In yet other implementations, the harvested atoms have an isotopic composition that can be combined with naturally occurring mercury to achieve a desired isotopic composition. In yet further implementations, the harvested atoms have an isotopic composition that can be combined one or more other sets of harvested mercury atoms to achieve a desired isotopic composition.

In act 440, the harvested mercury atoms are placed into a lamp envelope. In various implementations, the harvested mercury atoms are combined with one or more other naturally occurring or isotopically tailored mercury samples in the lamp envelope.

In act 450, the lamp envelope is sealed and prepared for use. An electric arc is passed through the lamp envelope to excite the mercury vapor and produce illumination from the mercury atoms.

Figure 5:
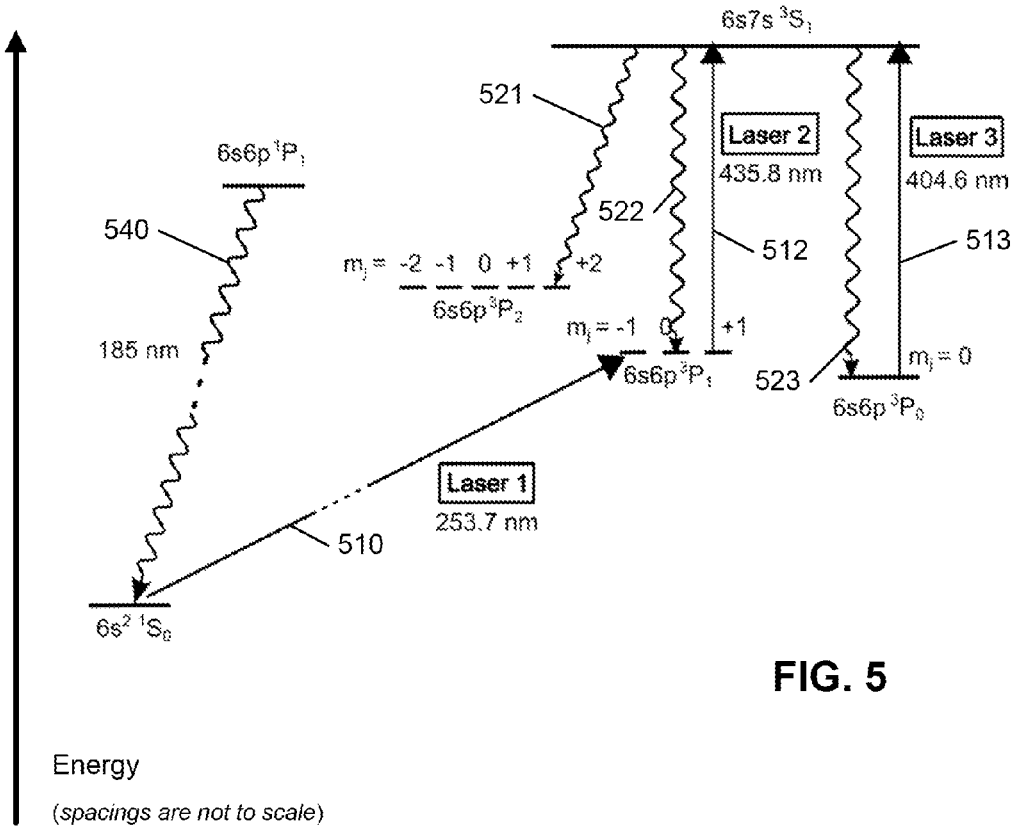
FIG. 5 shows an example of a pumping scheme using some of the atomic states in mercury.

FIG. 5 shows an example of an optical pumping scheme using some of the atomic states in mercury. A desired isotope of mercury can be separated from a beam by initially optical pumping it to a magnetic J≠0 state. In the illustrated example, the optical pumping can be accomplished by illuminating the mercury beam with light at an isotope-selective combination of three wavelengths. The first illumination is with light 510 ("Laser 1") at 253.7 nm, which drives the $6s^2\ ^1S_0$ to $6s6p\ ^3P_1$ resonance transition. The second illumination is with light 512 ("Laser 2") at 435.8 nm, to drive the atoms into the 6s7s $^3S_1$ level. From there, the atoms can decay by spontaneous emission into the target $6s6p\ ^3P_2$ metastable level via spontaneous emission 521.

This state has five $m_j$ substrates, including a non-magnetic substrate ($m_j$=0), two high-field seeking substrates ($m_j$=−2 and $m_j$=−1), and two low-field seeking substrates ($m_j$=+1 and $m_j$=+2). Some fraction of the spontaneously-emitting atoms from the 6s7s $^3S_1$ level are naturally expected to end in the most low-field seeking substrate ($m_j$=+2) of the $6s6p\ ^3P_2$ level. To augment the fraction of atoms that end in this substrate, additional lasers can be used and/or the polarizations of Laser 1 and Laser 2 can be optimized by appropriate selection of light polarization with respect to a weak magnetic field, so that the atoms are pumped the atoms into the $m_j$=2 "stretch" state of the $6s6p\ ^3P_2$ level. Atoms in this state are repelled by magnetic fields. (In other implementations, other magnetic states may also be used, such as $m_j$=−2, −1, or +1, to spatially separate the pumped atoms from the non-pumped atoms when they are later exposed to a magnetic field gradient).

A third illumination is with light 513 ("Laser 3") at 404.6 nm that may be used to pump stray atoms out of the $6s6p\ ^3P_0$ level, where they may have arrived by (undesired) spontaneous emission 523 from the 6s7s $^3S_1$ level. This third illumination can help reduce the fraction of atoms that can end up trapped in the $m_j$=0 (non-magnetic) substrate of the $6s6p\ ^3P_0$ level, thereby increasing the fraction of atoms that end up in the desired $m_j$=+2 substrate of the $6s6p\ ^3P_2$ level. Similarly, additional lasers at appropriate wavelengths and intensities (and possibly with appropriate polarizations) can be used to pump from other states to enhance the fraction of atoms that end in the $m_j$=+2 substrate of the $6s6p\ ^3P_2$ level. Undesired spontaneous emission 522 can also return atoms to the $6s6p\ ^3P_1$ level, but these atoms can be re-pumped by light 512 back up to the 6s7s $^3S_1$ level.

In one example, the optical pumping can be accomplished with a narrow-band UV laser at 253.7 nm, and two blue lasers at 404.6 nm and 435.8 nm respectively. One example of a UV laser uses optically pumped semiconductor technology. See, e.g., J. Paul, Y. Kaneda, T. L. Wang, C. Lytle, J. V. Moloney, R. J. Jones, "Doppler-free spectroscopy of mercury at 253.7 nm using a high-power, frequency-quadrupled, optically pumped external-cavity semiconductor laser," *Optics Letters*, v. 36, issue 1, pp. 61-63 (2011). The blue wavelengths can be reached with diode lasers in the near-IR, followed by tapered amplifiers and frequency doubling in an external cavity, or in a periodically-poled nonlinear crystal. The guide can be dimensioned and curved such that only the optically pumped atoms (which include a selected isotope or selected isotopes) can traverse an unobstructed path between the source and a collection point.

The optically pumped atoms that reach the collection point can then be collected (or discarded) to result in a sample of mercury with an altered isotope content. For example, in one implementation, the magnetic fields, guide geometries, and wavelengths of the optical pumping lasers can be chosen so that a collection point receives an enriched quantity of the mercury-196 isotope. These collected atoms can be added to a sample of mercury, thereby increasing the proportion of mercury-196. Alternatively, these collected atoms can be discarded, and the remaining mercury atoms can instead be harvested for use as a sample with a reduced fraction of mercury-196.

In one example, the first illumination is with light at 253.7 nm that is specifically tuned to address the $^{196}$Hg atoms. For example, the laser can be selectivity tuned to the +340 mK wavenumber offset depicted in FIG. 2. This selectivity is feasible since the isotopic features of this transition in mercury are approximately 50 mK wide, as shown in FIG. 2. These feature widths (~$50\times10^{-3}$ cm$^{-1}$ wide in wavenumber, corresponding to ~1.5 GHz wide in optical frequency) are substantially wider than the linewidth of lasers typically used for optical pumping (~few MHz). The other isotopes would be substantially transparent to this light, since their spectral line wings are vanishingly small at the +340 mK offset. Using the optical pumping scheme described above, with appropriate tuning for the two blue lasers, a significant fraction (e.g., approximately 5%, 10%, 15%, 20%, 25%, or more, with adjunct pumping lasers) of the $^{196}$Hg atoms (and almost none of the other isotopes) could be placed into the $m_j$=2 "stretch" state, which is repelled by magnetic fields. The entire sample of atoms could then be directed, entrained in a beam, into a guide that exposes the atoms to a magnetic gradient and blocks the passage of any atoms that do not follow a desired path through the guide. For example, the guide can be a volume with a magnetic gradient between two curved plates, with no direct straight-line path from entry to exit. Any non-magnetic mercury atoms would be blocked by the guide, since they would follow a straight-line path. However, with appropriate design of the geometry of the guides and the magnetic field, and a proper selection of the initial velocity distribution of the atoms, the pumped atoms (only $^{196}$Hg in this example) can navigate through the guide, since their path would be deflected by the magnetic field. The atoms that navigate through the guide can then be collected and added to a natural sample of mercury, to make a mercury vapor with a modified isotope distribution for use in a gas-discharge lamp (or other purposes).

In another example, multiple lasers can be used simultaneously or sequentially, with slightly different tunings, to address multiple isotopes of the mercury atoms. By choosing different intensities for these lasers, different proportions of the various isotopes can be pumped into one or more magnetic states. Thus, several isotopes—in desired proportions—can be collected for further use. In one example, several lasers are tuned so that $^{196}$Hg and $^{198}$Hg are simultaneously collected, in a ratio of approximately 40:1. In other examples, several lasers are tuned so that two, three four, five, or six isotopes of mercury are collected in other ratios. In other examples, several lasers are tuned so that all seven isotopes of mercury are collected in a desired set of ratios (e.g., according to a mix such as prescribed by one of the rows in Table 1, or according to a related calculation). The results of various such examples can be combined to achieve a targeted isotopic mix for a mercury sample.

Similar techniques can be readily devised, with appropriate laser tuning, to enrich or deplete other isotopes from a sample of mercury. For example, the light wavelengths, magnetic fields, and guide geometries can be adapted to collect mercury that is substantially free of Hg-199.

In various applications, the relative isotopic abundance can be adapted for applications other than fluorescent lighting. For example, mercury vapor lamps can be used in some environments with modified fluorescent coatings, or even without any fluorescent coatings. Various applications use the 254 nm UV light directly from the mercury vapor for germicidal purposes. Some examples of these lamps include small discharge units without a fluorescent coating and with an envelope that is transparent to the desired UV light (254 nm). For example, a tube can be a half-inch diameter compact fused-silica tube curved into a "U" shape. Such lamps can be deployed in medical facilities, air-handling systems, and sterilization units for disinfecting or cleaning water, clothing, or other materials. Calculations such as those shown in Table 1 can be used or adapted for determining an isotopic composition for optimizing the power output and/or efficiency of these or other gas discharge units.

These techniques can also be used in other applications. For example, the 185 nm light emitted by a mercury-vapor discharge (transition 540 in FIG. 5) can be used in the production of ozone. In various implementations, a mercury vapor can be generated with a relative isotopic abundance that enhances the output or efficiency of 185 nm light generated by a lamp used for ozone generation.

The principles and modes of operation of this invention have been described above with reference to various exemplary and preferred embodiments. As understood by those of skill in the art, the overall invention, as defined by the claims, encompasses other preferred embodiments not specifically enumerated herein.

What is claimed is:

1. A composition comprising mercury, wherein:
the abundance of mercury-204 in the mercury is in the range of 15.5%-30%.

2. The composition of claim 1, consisting of:
mercury-196 in an abundance of 10%-20%;
mercury-198 in an abundance of 10%-20%;
mercury-199 in an abundance of less than 12%;
mercury-200 in an abundance of 10%-20%;
mercury-201 in an abundance of 10%-20%;
mercury-202 in an abundance of 10%-20%; and
mercury-204 in an abundance of 20%-30%.

3. The composition of claim 1, wherein the isotopic proportions of the mercury are:
0% or more mercury-196;
10% or more mercury-198;
12% or less mercury-199;
10% or more mercury-200;
10% or more mercury-201;
10% or more mercury-202; and
15.5%-30% mercury-204.

4. The composition of claim 1, wherein the composition is comprised in a lighting device.

5. A lighting device comprising:
a container having a first geometry;
a buffer gas held in the container, wherein the buffer gas has a first composition; and
a sample of mercury held in the container, wherein
the sample of mercury consists of a non-naturally occurring mixture of isotopes, and
the non-naturally occurring mixture of isotopes provides the lighting device with an escape rate, to the container, of 254-nm radiation that is more than 16% higher than a comparative escape rate for
a comparative lighting device with a container having the first geometry, a buffer gas having the first composition, and a sample of mercury with a naturally occurring mixture of isotopes.

6. The lighting device of claim 5, wherein:
the non-naturally occurring mixture of isotopes provides the lighting device with an escape rate of 254-nm radiation that is more than 18% higher than the comparative escape rate.

7. The lighting device of claim 5, wherein the container comprises an envelope with a fluorescent coating.

8. The lighting device of claim 5, wherein the container comprises an envelope that is transparent to 254-nm radiation.

9. A lighting device comprising:
a container having a first geometry;
a buffer gas held in the container, wherein the buffer gas has a first composition; and
a sample of mercury held in the container, wherein
the sample of mercury consists of a non-naturally occurring mixture of isotopes, and
the non-naturally occurring mixture of isotopes provides the lighting device with an escape rate, to the container, of 185-nm radiation that is more than 5% higher than a comparative escape rate for
a comparative lighting device with a container having the first geometry, a buffer gas having the first composition, and a sample of mercury with a naturally occurring mixture of isotopes.

10. The lighting device of claim 9, wherein:
the non-naturally occurring mixture of isotopes provides the lighting device with an escape rate of 185-nm radiation that is more than 15% higher than the comparative escape rate.

11. The lighting device of claim 9, wherein:
the non-naturally occurring mixture of isotopes provides the lighting device with an escape rate of 185-nm radiation that is more than 20% higher than the comparative escape rate.

12. The lighting device of claim 9, wherein the container comprises an envelope that is transparent to 185-nm radiation.

13. The composition of claim 1, wherein:
the abundance of mercury-196 in the mercury is at least 4%.

14. The composition of claim 1, wherein:
the abundance of mercury-199 in the mercury is less than 16%.

15. A composition comprising mercury wherein:
the abundance of mercury-204 in the mercury is in the range of 20%-30%.

16. The composition of claim 1, wherein:
the abundance of mercury-204 in the mercury is about 15%.

17. The composition of claim 1, wherein:
the abundance of mercury-204 in the mercury is about 25%.

18. The composition of claim 1, wherein:
the abundance of mercury-204 in the mercury is about 27%.

19. The composition of claim 1, wherein:
the abundance of mercury-204 in the mercury is in the range of 15.5%-21%.

20. A composition comprising mercury wherein:
the abundance of mercury-204 in the mercury is in the range of 21%-27%.

21. The composition of claim 1, wherein:
the abundance of mercury-204 in the mercury is in the range of 27%-30%.

22. The composition of claim 1, wherein:
the abundance of mercury-204 in the mercury is about 16%.

23. The composition of claim 1, wherein:
the abundance of mercury-204 in the mercury is about 17%.

24. The composition of claim 1, wherein:
the abundance of mercury-204 in the mercury is about 18%.

25. The composition of claim 1, wherein:
the abundance of mercury-204 in the mercury is about 19%.

26. The composition of claim 1, wherein:
the abundance of mercury-204 in the mercury is about 20%.

27. The composition of claim 1, wherein:
the abundance of mercury-204 in the mercury is about 21%.

28. The composition of claim 1, wherein:
the abundance of mercury-204 in the mercury is about 23%.

* * * * *